US005938376A

United States Patent [19]

Alcaraz

[11] Patent Number: 5,938,376

[45] Date of Patent: Aug. 17, 1999

[54] AUTOMATED TEMPORARY ROOF SUPPORT, BOLTER AND METHOD

[76] Inventor: Robert J. Alcaraz, P.O. Box 645, 7 Axle Road, Clayville Extension 11, Olifantsfontein I665, South Africa

[21] Appl. No.: 08/851,837

[22] Filed: May 6, 1997

[51] Int. Cl.[6] ..... E21C 9/00; E21D 23/04; E21D 23/08; E21D 23/20

[52] U.S. Cl. ..... 405/303; 173/31; 173/37; 405/288; 405/291

[58] Field of Search ..... 405/258, 259.1, 405/303, 288, 290, 291; 299/11, 33; 173/31, 32, 34, 37, 186

[56] References Cited

U.S. PATENT DOCUMENTS

| | | | |
|---|---|---|---|
| 4,117,894 | 10/1978 | Saunders | 173/23 |
| 4,284,368 | 8/1981 | Albright | 405/291 |
| 4,595,316 | 6/1986 | Tinnel | 405/291 |
| 4,640,369 | 2/1987 | Goyarts | 173/42 |
| 5,156,497 | 10/1992 | Gaskins | 405/291 |

OTHER PUBLICATIONS

Model LTDO with ATRS, Fletcher Mining Equip., Bulletin No. LTDO–0489, 1986, Huntington, WV.

Model DR, Fletcher Mining Equip., Bulletin No. DR–0489, 1986, Huntington, WV.

Model HDDO, Fletcher Mining Equip., Bulletin No. HDDO–0986 Rev. Mar. 1993, Huntington, WV.

Model DDO, Fletcher Mining Equip., Bulletin No. DDO–0986, 1986, Huntington, WV.

Model DDR, Fletcher Mining Equip., Bulletin 001/2, 1989, Huntington, WV.

Model RR–1, Fletcher Mining Equip., Bulletin RR–1/1, Oct. 1990, Huntington, WV.

Model RR–II Low Profile, Fletcher Mining Equip., Bulletin No. LRR2/1, Nov. 1990, Huntington, WV.

Model HDDR, Fletcher Mining Equip., Bulletin No. HDDR–WT–0489, Rev. Aug. 1992, Huntington, WV.

*Primary Examiner*—Tamara Graysay
*Assistant Examiner*—Tara L. Mayo
*Attorney, Agent, or Firm*—Woods, Rogers & Hazlegrove, PLC; C. Fred Rosenbaum

[57] ABSTRACT

In an automated temporary roof support and roof bolting machine there are several safety features. The machine has forward operator's stations on each side of the machine. All the controls for operating the machine are in the operator's stations. The machine is pulled forward, a precise distance, by a hydraulic cylinder with a limited stroke. The pulling of the machine is controlled by safety switches requiring both operators to operate the switches in unison.

17 Claims, 2 Drawing Sheets

AUTOMATED TEMPORARY ROOF SUPPORT, BOLTER AND METHOD

RELATED APPLICATIONS

This application is related to application Ser. No. 08/738,570 filed Oct. 28, 1996, titled Mechanized Shoring Apparatus, inventor Robert J. Alcaraz. application Ser. No. 08/738,570 is incorporated by reference herein.

BACKGROUND OF THE INVENTION

The continuing development of mine safety regulations has contributed greatly to the reduction of accidental injuries in mining operations. The increased use of automated machinery is a result of industry efforts to provide personnel safety and maintain or increase production. The use of automated machinery removes personnel from the most dangerous areas of the mine; the working face and the unsupported roof of the mine shaft. Introducing machines into the mine near the working face results, in effect, in the addition of another hazard to the personnel.

In the forward portion of the working face there are conditions of very confined spaces, loud noise, and restricted visibility. When miners are working on opposite sides of a machine each is frequently out of sight of the other. The machines are usually electrically powered and hydraulically controlled and move with such force that they can easily injure, maim or kill.

Specifically, the dual boom roof bolting operation which this invention is concerned with requires two miners whose work stations, while in the bolting operation, are on opposite sides of the roof bolting machine. Each miner operates a hydraulically powered roof bolting boom to drill holes in the unsupported roof and place reinforcing roof bolts therein. The booms have controls to operate independently of each other and are capable of moving horizontally and vertically in the mine shaft. With current machinery, it is possible for one of the miners to leave his position and move about the front area of the machine while the other miner is operating the apparatus. Such conditions invite an accident.

The dual boom roof bolting machine of this invention is a mobile apparatus which can be attached to the front end of a conventional tramming vehicle. Tramming vehicles have powered wheels and usually carry the hydraulic pumps, reservoirs, with associated valving, and other required accessories, such as electrical connections, with them to the working face of the mine. The tramming vehicle has controls for forward and reverse movement conventionally placed at or near the rear of the vehicle and are used primarily for moving the machine to and from the working face. At this position, the operator cannot see the periphery of the vehicle or the attached roof bolting machine. The other operator may not be visible when the vehicle is moved, again inviting an accident.

SUMMARY OF THE INVENTION

In developing more and more machines to operate in the mines, the emphasis has been on protecting the personnel from the mine environment. It is an object of this invention to protect the personnel from the machines.

It is an object of this invention to provide a roof bolting machine having dual roof bolting booms and an automated temporary roof support (ATRS). The ATRS provides temporary support of the mine roof while the roof bolts are installed using drill heads on the dual boom roof bolters. Additionally, the ATRS provides locomotion for the entire machine by extension and contraction of the hydraulic cylinder.

In the dual boom roof bolting machine of this invention, the miners must be positioned at a particular location when the machine is being extended or contracted for the next sequence of bolting. This location is the operator's station. If both the miners are not at their assigned places the roof bolting machine will not move and, likewise, if one of the miners leaves his place during movement the machine will immediately stop. For safety in operation, each operator station is provided with a spring return pilot valve which must be constantly engaged for movement of the machine. Such spring return pilot valves may be responsive to the operator's weight, such as in the operator's seat, or a foot pedal or a hand operated movable switch. It is an object of this invention to eliminate need for either operator to move beyond the protection of the operator's station during the roof bolting procedure.

Rather than pushing the temporary roof support into position using the tramming vehicle, the tramming vehicle remains stationary while the hydraulic cylinder of the ATRS is hydraulically extended a predetermined length and the temporary roof support deployed to provide support. After the roof bolts are installed, the ATRS is released from temporary support and the extension barrel is extended a predetermined distance, the ATRS is then spread to support the roof and the extension barrel is retracted or shortened. In this manner, the entire machine is pulled forward by the ATRS. This allows operators additional protection from falling debris and unnecessary mechanical movement. This entire operation is completed while the miners are in their respective stations and the respective safety switches are engaged.

DETAILED DESCRIPTION

Figure 1:
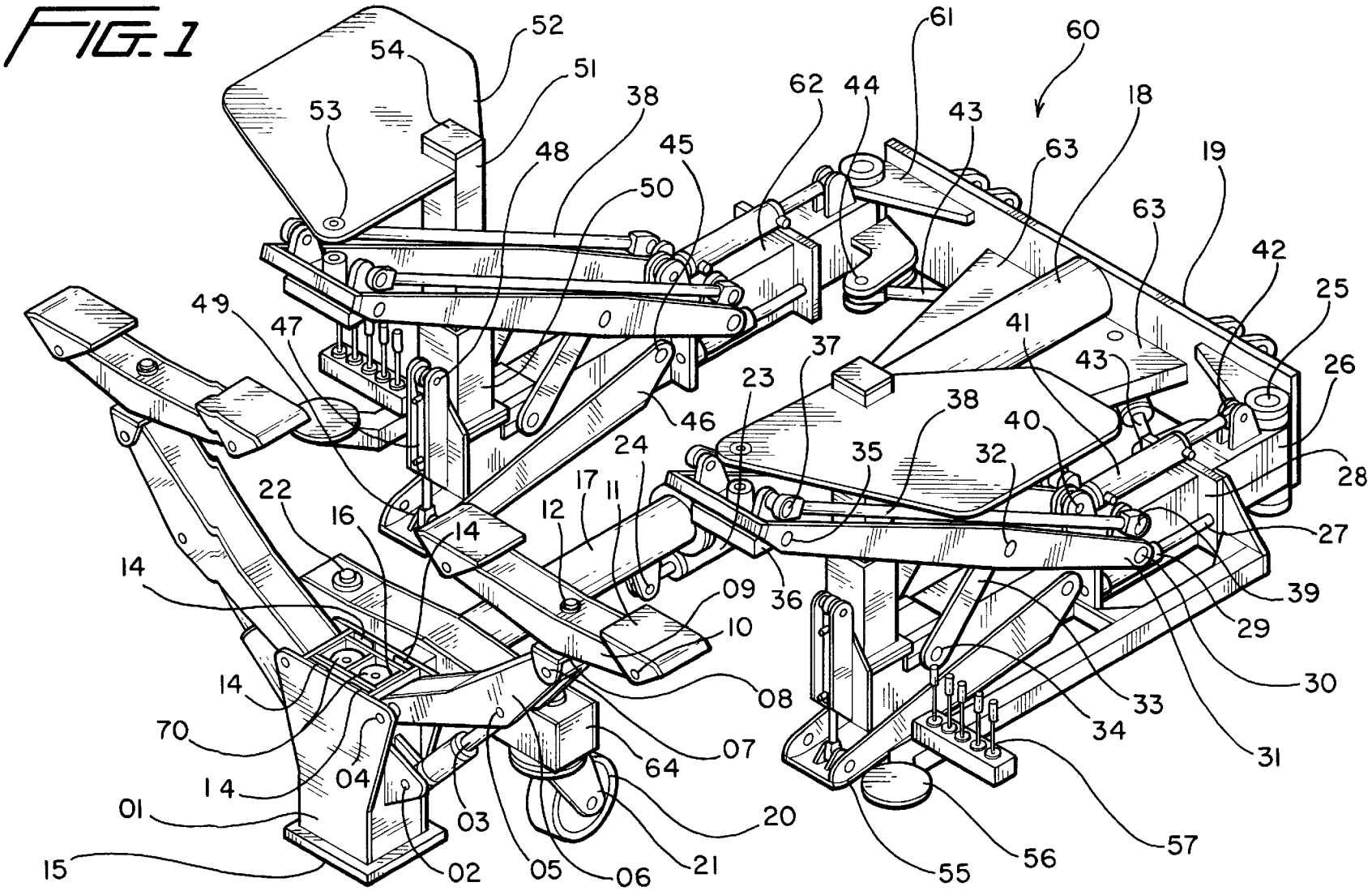
FIG. 1 is a perspective side view of the machine.

In FIG. 1, the entire roof bolting machine 60 is shown in a side view. The roof bolting machine 60 is adapted to be attached to and cooperate with standard tramming vehicles. The main body chassis of a tramming vehicle mounted on powered wheels does not form a part of this invention. The roof bolting machine is operatively connected to the tramming vehicle which carries the power sources, such as hydraulic reservoirs and electric pumps along with electrical connections. The ATRS and the dual boom roof bolters have hydraulic lines and electric cables operatively connected to the main body chassis to power the different parts of the sections. These lines and cables may be individually connected or they may be ganged in a quick disconnect type of fitting carried on the tramming vehicle or the forward sections.

The hydraulic system is conventional and is not shown, in it's entirety, for clarity in the drawings. This is true of the electrical system as well. The dual boom roof bolters are identical and any reference numeral shown on one boom identifies an element present on both booms. The hydraulic power is controlled from each operator's station by a set of operator pilot controls 57.

The tramming vehicle is attached to roof bolting machine by mounting plate 19. The particular attachment device to connect the mounting plate 19 to a tramming vehicle would depend on the conventional vehicle to be used, here two hinge joints (unnumbered) are shown to permit relative movement between the tramming chassis and the roof bolting machine 60 as the entire assemblege rolls over the uneven surface of the mine floor.

As shown in FIG. 1, the connector plate 19 has another set of hinges 61, one at each end of the connector plate. These hinges cooperate with a fixed box 26 formed in the rear end portion of the roof bolter boom 62 and a swivel pin 25. The booms 62 are moved laterally with the hydraulic swing cylinder 43 through the link 44 which is connected to the hinge 61. The other end of the hydraulic cylinder and piston is connected to the connector plate 19. The lateral movement of the roof bolter boom is controlled by one of the set of pilot controls 57.

Both drilling boom arms 31 are shown raised from the travel position to the drilling position. The vertical movement of the drilling boom arm 31 results from operation of extension cylinder 41 controlled by the pilot controls 57. Extension cylinder 41 is connected to the boom 62 by clevis 42 and the drilling boom arm 31 by extension box and pin 40. The upward movement places the drilling head 36 near the roof of the mine shaft. In moving to this position the base of the drilling boom arm 31 rotates about pin 30 which, in turn, is mounted on slide bushing 29 to slide forward and aft on slide shaft 27. Shaft 27 is mounted parallel with the roof bolter boom by extension box 28. Intermediate the ends of the drilling boom is the elevating arm 33 connected to the roof bolter boom by bottom pin 34 and the drilling boom by top pin 32. In this fashion, the elevation can be manipulated through the controls 57. The drilling boom also carries adjacent it's top surface, leveling rods 38. These rods move with the drilling boom through pins 37. The rods 38 provide directional control to the drill bit and roof bolt to insure the perpendicular placement of the roof bolts in the shaft roof. The leveling rods 38 also rotate about pin 39 carried by the base of the drilling boom.

The drill bit (not shown) is mounted on the drill head 36 of the drilling boom. To maintain the drill head level during movement of the boom, the drill head is connected to the boom by drill head journal 35. In operation, the rotating bit creates a hole in the roof of the mine that extends through the roof surface layer into the more stable layers above the exposed surface. The drilling boom then is lowered and the roof bolt is inserted into the drilled hole and fixed in place.

At the forward end or second end of the boom 62, a telescopic pylon, formed of a canopy outer box 50 and a canopy inner box 51 terminating in a canopy top plate 54, carrying an operator's seat 56 and a roof plate 52 is mounted. In another modification (not shown) the forward portion of the roof bolters under the roof plate. The roof plate is configured so as to extend over the drill head 36. An aperature is formed through the roof plate in the nature of a drill guide 53. The upper surface of the drill guide 53 may be shaped to receive roof bolt plates.

The telescoping sections 50 and 51 of the box beam permit vertical adjustment of the roof plate. The operator's seat 56 is adjustable on the outer box 50. The seat is adjustable so that the operator can conveniently reach the drill head 36 and the controls 57 which include the safety switch.

Also, at the end of the booms 62 are mounted a hydraulic stabilizer cylinders 47. The stabilizer cylinder 47 is attached to the boom 62 through the top pin 48. The other end of the stabilizer cylinder is connected to a floor plate 55 through bottom pin 49. The floor plate is movably connected to the boom 62 through the stabilizer arm 46 and rear stabilizer pin 45. The stabilizer cylinder 47 is retracted when the boom is to be moved and extended to contact the floor of the mine when the drilling boom is operated. The stabilizer cylinder provides support and stability to the forward end of the boom when the drill engages the roof.

The automated temporary roof support section includes the ATRS fixed barrel 18 attached to the front major surface of the connector plate 19 between the dual roof bolter booms 62. The fixed barrel 18 and connector plate 19 are stabilized and reinforced by flange 63 angularly disposed and connected between the fixed barrel 18 and the connector plate 19, on each side of the fixed barrel 18. The ATRS has two main purposes, one of which is to temporarily support the unstablized mine shaft roof until the immediate area is bolted. The second main purpose is to act as the motive force for the entire roof bolting machine when the operators are at the front of the machine. Another purpose is to reliably measure the distance between each row of roof bolts.

In operation, controls 57 actuate the hydraulic cylinder 23 which is connected through the extension cylinder clevis 24 at one end to extension barrel 17 and the other end to fixed barrel 18 to extend the telescoped extension barrel 17 of the ATRS into the unbolted mine. During this movement, the forward end of the extension barrel 17 is carried by the wheels 20. The wheels 20 are mounted on a truck 64 which is mounted on the ATRS barrel. The wheels are attached to the truck by a caster 21 and pin 22 permitting the truck to caster and align the wheels in response to the direction of movement of the ATRS. When the barrel is fully extended, the ATRS is hydraulically spread to engage the mine floor and the mine roof to provide support. Because the twin pivot 1 has a greater extended length than the radius of the wheels, the wheels are raised out of contact with the floor.

Figure 3:
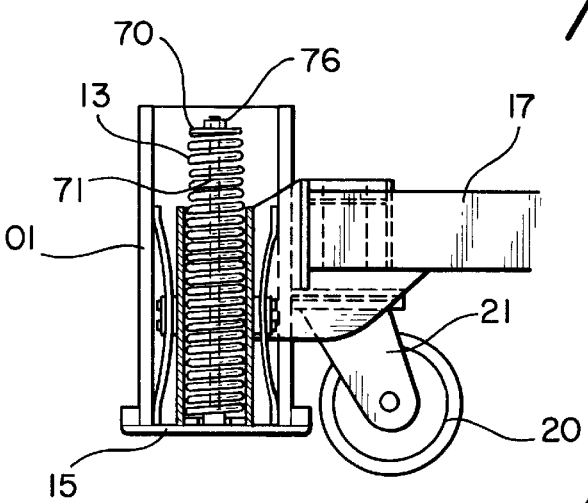
FIG. 3 is a partial cross section of the ATRS twin pivot in the retracted position.
Figure 4:
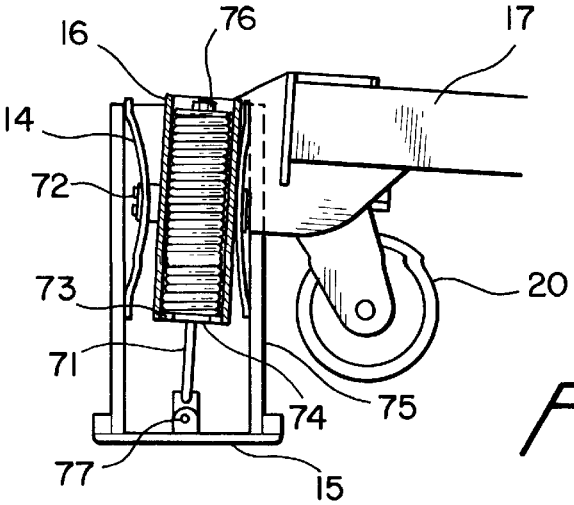
FIG. 4 is a partial cross section of the ATRS twin pivot in the support position.

The twin pivot 1 is an integral part of the temporary support of the roof. As shown in FIG. 1, the twin pivot 1 is in the same vertical plane as the roof support assembly. As seen in FIGS. 3 and 4, the twin pivot 1 is mounted on the end portion of the extension barrel 17 forward of the wheels 20. The twin pivot is a box beam movably mounted on the barrel and terminating in a floor plate 15. The connection between the barrel 17 and the twin pivot 1 is through a slot 75 in the rear wall of the box beam shown in FIG. 4. The barrel 17 is attached to the sliding box 16. The sliding box 16 has an open top end and a closed lower end 73 with an aperature 74 therein. Inside the sliding box 16 there are two coil springs 13 attached to the closed lower end. Extending through the coil spring from top to bottom is a telescoping tube 71. The top end of the tube has a washer 70 resting on the top of the coil spring and held in place by a nut 76 threaded to the end of telescoping tube 71. The bottom of the tube extends through the aperature 74 in the sliding box and is attached to the floor plate 15 through a pivot pin 77. The ATRS is extended by elongation of the barrel 17 at which time the forward portion of the ATRS is in the travel position shown in the dotted lines of FIG. 2. The twin pivot 1 is in the position shown in FIG. 3 wherein the weight of the temporary support is carried by the coil springs 13 through the washers 70 on the top of the coil springs and the attachments with the bottom of the sliding box 16. The weight of the structure forces the coil springs to elongate. The elongation of the coil springs results in the elongation of the telescoping tube 71. Ultimately, all this weight is carried by wheels 20.

Figure 2:
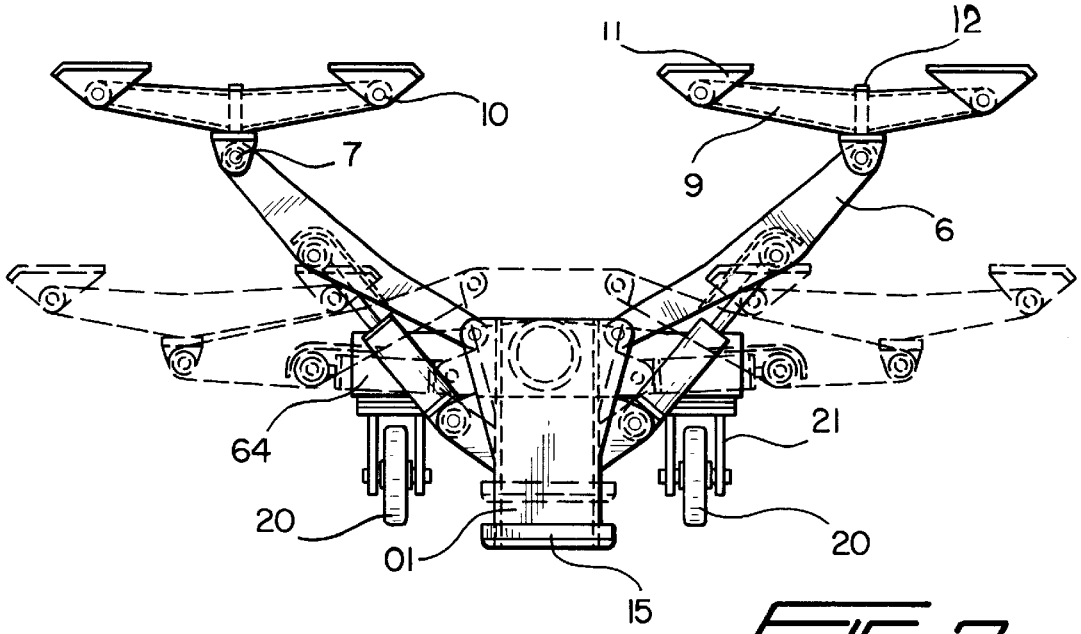
FIG. 2 is a front view of the forward end of ATRS including the caster wheel axle and ATRS twin pivot showing the travel position in phantom lines.

With the ATRS in the desired position, the temporary support is spread to the support position, as shown in the full lines of FIGS. 2 and 4. As the hydraulic ATRS cylinder elongates, the bottom arm 6 pivots upwardly through the connection at top pin 5. The roof shoes 11 will contact the roof of the mine and the force of the expansion will be transmitted to the twin pivot 1 through the hydraulic cylinders 3 and pivot pin 2. The force will move the box beam downwardly until the floor plate 15 contacts the floor of the mine. The downward movement of the twin pivot 1 results in the twin pivot taking the weight of the temporary support structure off the caster wheels. As the load on the wheels lessens the coil springs 13 overcome the residual weight of the barrel and contract upwardly. Thus the wheels 20 are disengaged with the floor by the contracting coil springs.

FIGS. 1 and 2 show the temporary support apparatus formed in the shape of a Y with the twin pivot 1 forming the base and the bottom arms 6 each forming an identical arm of the Y. The arms of the Y are pivotally mounted to the base by bottom pin 4. The free ends of each arm of the Y are attached to the middle of another beam or top arm. At the ends of the top arms are roof shoes. As the ATRS spreads to the support position, the roof shoes 11 contact the roof of the mine. The roof shoes are mounted on the top arm 9 by pivot pin 10 which allows the roof shoe to tilt in the vertical plane to engage uneven roof surfaces. The top arm 9 is pivotally mounted on the bottom arm 6 by a pivot pin 7 which permits the entire arm to tilt in the vertical plane. The pivot pin 7 has a swivel clevis 8 and a spring loaded swivel pin 12 which allows the top arm 9 to rotate in the horizontal plane so that the top arm can return to the support position, if the arm is dislodged by striking the side wall of the mine.

As can be seen by FIGS. 3 and 4, the attachment between the sliding box 16 and the forward end of the barrel 17 is through a pivoting journal 72 which allows limited angular lateral movement of the sliding box 16 within twin pivot 1. The angular lateral movement is controlled by diametrically mounted leaf springs 14 located between the sliding box 16 and the inner surface of twin pivot 1. This permissible angular displacement of the sliding box 16 allows it's vertical movement within the twin pivot 1 even though the twin pivot is not vertically disposed to accommodate mine floor surfaces which are not level.

When the material is extracted from the mined portion of the face there is an area of unsupported roof between the last row of bolts and the new face. In operation, the bolting machine is positioned with the operator's station near the last row of roof bolts. The ATRS is spread to support the unbolted roof. The drilling section is then activated to drill the necessary number of bolt holes perscribed by regulations and the roof bolts are installed. The ATRS is then collapsed to the travel position and the barrel is extended a predetermined distance. The ATRS is then activated to spread into the support position and contract the extension barrel resulting in forward movement of the entire machine. Once the extension barrel is foreshortened, the operators begin the drilling sequence again. All these movements of the ATRS are accomplished by manipulation of the control valves and safety valves in the operator's cabs.

I claim:

1. In an automated temporary roof support, ATRS, adapted for connection with a tramming vehicle to form a mobile assembly, said ATRS comprising a mounting plate and a temporary roof support assembly means, said mounting plate having two opposed surfaces, one of said surfaces of said mounting plate having connecting means for relative movement between said mounting plate and said tramming vehicle, the second opposed surface of said mounting plate having locomotion means for moving said mobile assembly, said locomotion means comprising telescoping barrels composed of a fixed barrel and an extension barrel, one end of said fixed barrel connected to said second opposed surface of said mounting plate, said fixed barrel having the other end telescopically coupled with the first end of said extension barrel to permit the overall length of said locomotion means to be extended and shortened, the other end of said extension barrel flexibly attached to said temporary roof support assembly means, said temporary roof support assembly mean comprising top arms and a floor plate movably connected for vertical extension and contraction of the distance therebetween whereby movement of said mobile assembly results when said temporary roof support assembly means is vertically extended and said locomotion means is shortened.

2. In an ATRS of claim 1, wherein said temporary roof support assembly means includes a castering wheel truck mounted on ail extension barrel near said temporary roof support assembly means, said castering wheel truck bearing the weight of said extension barrel and said temporary roof support assembly means when said distance between said top arms and said floor plate is reduced.

3. In an ATRS of claim 2 wherein said temporary roof support assembly means is in the form of a box beam and said floor plate forms the end surface of said box beam, said box beam having upwardly extending side walls from said floor plate and enclosing a sliding box, said sliding box having a spring means resiliently mounted to said floor plate for carrying the weight of the ATRS, one of said side walls having a slot, said extension barrel attached to said sliding box through said slot whereby said temporary roof support assembly means is resiliently carried by said castering wheel truck.

4. In an ATRS of claim 2 wherein the flexible connection between said other end of said extension barrel and said temporary roof support assembly means is slidable so that said floor plate bears the weight of said extension barrel and said temporary roof support assembly means when said distance between said top arms and said floor plate is extended.

5. In an ATRS of claim 4 wherein said temporary roof support assembly means has bottom arms each pivotally attached at one end to opposite side walls of said box beam, each of the other ends of said bottom arms pivotally attached at the central area of one of said top arms, respectively, each end of said top arms carrying a roof shoe, each roof shoe being pivotally attached to said ends of said top arms.

6. In an ATRS of claim 5 wherein said top arms include resilient means for rotation of said top arms about said pivotal attachment with said bottom arms for returning said top arms to the original position after deflection.

7. In an ATRS of claim 1 wherein said telescoping movement of said fixed barrel and said extension barrel and said movement of said top arms and said floor plate is hydraulically activated by pilot control valves.

8. In an ATRS of claim 7 wherein said pilot control valves include a spring return pilot valve means which must be continuously biased for hydraulic activation.

9. In an ATRS of claim 1 wherein a roof bolter is affixed to said mounting plate adjacent said one end of said fixed barrel, said roof bolter comprising a movable boom and a drilling section, said boom having a front portion, a middle portion and a rear portion, said front portion of said boom having an operator station including pilot control valves whereby the telescopic movement of said fixed and said extension barrels, and movement of said boom, is controlled.

10. In an ATRS of claim 9 wherein said pilot control valves include a safety valve in the form of a spring return pilot valve which must be continuously biased for activation of said pilot control valves.

11. In an ATRS of claim 10 wherein a second roof bolter is affixed to said mounting plate adjacent said one end of said fixed barrel with said end of said fixed barrel being disposed between said roof bolters.

12. In a roof bolter adapted for connection of a tramming vehicle, said roof bolter comprising a mounting plate, a laterally movable boom and a drilling section, said boom having a front portion, a middle portion and a rear portion, said rear portion of said boom pivotally connected to said mounting plate, said drilling section including a boom arm having a front end and a rear end, said rear end of sad boom arm being movably mounted on said rear portion of said boom for vertical movement, a drill head movably attached to said front end of said boom arm, said front portion of said boom having an operator station including pilot valve controls whereby movement of said boom, said boom arm and said drill is controlled, said operator station has a canopy therefor, said canopy having a pylon connected at one end to said boom at said front portion and a roof plate carried by the other end of said pylon, said roof plate extending above said drill head and having an aperature aligned with said drill head to serve as a drill guide.

13. In a roof bolter of claim 12 wherein said canopy has an upper surface and a lower surface, said lower surface facing said boom, said upper surface of said canopy shaped about said aperature to slidably receive a roof plate.

14. In a roof bolter of claim 12 wherein said roof bolter is a dual boom roof bolter comprising two booms.

15. In a roof bolter of claim 12 wherein said front portion of said foam carries a stabilizer means, said stabilizer means includes a hydraulically operated floor plate means for supporting said front portion of said booms.

16. In a method of installing roof bolts in a mine using a tramming vehicle connected to a roof bolter having at least one movable boom and an automated temporary roof support, ATRS, by a mounting plate, wherein said at least one boom is pivotally mounted at one end on said mounting plate to pivot laterally and carried a boom arm pivotally attached to move vertically, said boon arm having a drill head thereon for drilling roof bolt holes, said at least one boom having an operator station on the other end with pilot control valves, said ATRS having a fixed barrel attached on one end to said mounting plate, said ATRS including an extension barrel telescopically mounted on the other end of said fixed barrel carrying a temporary roof support means on the remote end of said extension barrel, said temporary roof support means having a floor plate and roof shoes, said temporary roof support means being movable from a vertically extended support position to a contracted travel position, the steps of;

(1 ) operating said pilot control valves to vertically extend said temporary roof support means so that said roof shoes contact the roof of a mine and said floor plate contacts the floor of the mine, (2) operating said pilot control valves to move said boom, said boom arm and said drill head to place a plurality of roof bolt holes in the roof of a mine, (3) placing roof bolts in the drilled holes, (4) operating said pilot control valves to vertically contract said temporary roof support means, (5) operating said pilot control valves to telescopically extend said extension barrel and thereby move said temporary roof support means forward, (6) operating said pilot control valves to vertically extend said temporary roof support means so that said roof shoes contact the roof of a mine and said floor plate contacts the floor of a mine, (7) operating said pilot control valves to telescopically shorten said extension barrel thereby drawing said mounting plate and said tramming vehicle toward said temporary roof support means, and (8) repeating steps 2–7 as necessary.

17. In the method of installing roof bolts claimed in claim 16, wherein said pilot control valves include a spring return pilot control valve, the biasing of said spring return control valve necessary for movement of said ATRS, the further step of continuously biasing said spring return control valve during movement said ATRS.

* * * * *